United States Patent [19]

Lindlau

[11] 4,195,901

[45] Apr. 1, 1980

[54] ELECTRICAL DEVICE WITH TERMINAL RETAINER

[75] Inventor: Paul F. Lindlau, East Orange, N.J.

[73] Assignee: Amerace Corporation, New York, N.Y.

[21] Appl. No.: 848,572

[22] Filed: Nov. 4, 1977

[51] Int. Cl.[2] ..... H01R 9/10

[52] U.S. Cl. ..... 339/198 GA; 339/272 A; 339/59 M; 339/61 M

[58] Field of Search ..... 339/59 R, 59 M, 61 R, 339/61 M, 62, 198 R, 198 G, 198 GA, 272 R, 272 A, 272 UC, 176 MP

[56] References Cited

U.S. PATENT DOCUMENTS

| | | | |
|---|---|---|---|
| 2,911,610 | 11/1959 | Kirk | 339/17 |
| 3,178,674 | 4/1965 | Scheller | 339/217 |
| 3,245,029 | 4/1966 | Piperato | 339/198 |
| 3,253,251 | 5/1966 | Norden | 339/272 UC |
| 3,273,109 | 9/1966 | Moulin | 339/176 |
| 3,319,212 | 5/1967 | Smith et al. | 339/64 M |
| 3,517,370 | 6/1970 | Poingt | 339/59 R |
| 3,631,381 | 12/1971 | Pittman | 339/176 MP |
| 3,633,152 | 1/1972 | Podmore | 339/91 R |
| 3,697,926 | 10/1972 | Krafthefer | 339/17 L |
| 3,697,933 | 10/1972 | Black et al. | 339/192 R |
| 3,930,706 | 1/1976 | Obuch et al. | 339/64 M |
| 3,990,759 | 11/1976 | Crowe | 339/59 R |
| 4,013,331 | 3/1977 | Kobler | 339/59 R |

FOREIGN PATENT DOCUMENTS

| | | | |
|---|---|---|---|
| 2610840 | 10/1976 | Fed. Rep. of Germany | 339/59 R |
| 1030091 | 5/1966 | United Kingdom | 339/59 M |
| 1281009 | 7/1972 | United Kingdom | 339/59 R |

*Primary Examiner*—Paul A. Bell

*Attorney, Agent, or Firm*—Ken Richardson; S. Michael Bender

[57] ABSTRACT

An electrical terminal block is provided with a plurality of terminal-receiving cavities therein and a corresponding plurality of electrical terminal elements disposed within the terminal-receiving cavities. Each terminal-receiving cavity includes a protruding retention member extending into the terminal-receiving cavity. Each terminal element includes a chamfered key member thereon, which is adapted to be captured and to interlock with a complementary retention member during insertion of the terminal elements into their respective cavities. The retention members and their corresponding cooperatively engaging chamfered key members selectively provide means for securing or facilitating removal of the inserted terminal elements.

20 Claims, 4 Drawing Figures

ELECTRICAL DEVICE WITH TERMINAL RETAINER

BACKGROUND OF THE INVENTION

1. Field of the Invention

The present invention generally relates to an electrical terminal block and, more particularly, to complementary interlocking retention members and key members which jointly provide a means for both selectively separably securing and facilitating removal of electrical connector elements and electrical terminal elements assembled into the block.

2. Description of the Prior Art

Prior electrical terminal blocks such as one-piece, sectional, and modular type blocks typically are provided with electrical connector elements disposed within connector-receiving cavities thereof for holding electrical conductive wires therein, as well as with electrical terminal elements disposed within terminal-receiving cavities thereof for electrically connecting other conductive wires to corresponding ones of conductive wires retained by the connector elements. The connector-receiving cavities as well as the terminal-receiving cavities are defined by the internal confines of either a multi-piece constructed block body or a single-piece constructed block body.

In assembling one or more of the connector elements and one or more of the terminal elements within the block, complementary terminal elements and connector elements, in many instances, are first permanently combined with one another to form therefrom single integral elements. The combined terminal elements and connector elements are next positioned in their respective cavities. The intermating pieces or portions of the block containing the combined terminal elements and connector elements, including fastener elements if utilized, are then permanently joined with one another to form therefrom a fully assembled unit block. However, in this type of assembly the whole unit block needs to be replaced if it fails, particularly, as a consequence of broken connector elements and terminal elements therein, or as a consequence of any number of other common causes such as electrical shorts, a fractured body, and failure of equipment and/or machinery interfacing with the block.

Additionally, disadavantages may also arise when several interconnecting type fully assembled sectional unit blocks are mounted in ganged assemblies. In a ganged assembly, each interconnecting sectional unit block is provided with a dovetail fitted onto its base, and is mounted via its dovetail in a retention channel adaptable for receiving a plurality of dovetails. The retention channel is usually mounted on a suitable foundation. But in this latter arrangement, if any unit block should fail, repositioning and/or removal of many, if not all, of the several unit blocks in the ganged assembly is required. Moreover, it is more likely than not, after expending the time consuming effort of locating, repositioning and/or removing the particular unit block that failed from the ganged assembly, the whole unit block will still need to be replaced to effect repair thereof.

Against this background, it is an object of this invention to provide a one-piece constructed electrical terminal unit block containing therein electrically combined electrical connector elements and electrical terminal elements, which are selectively separably removable and replaceable, such that, the electrical connector elements and the electrical terminal elements, if failed, are each capable of repair without replacing the whole unit block.

It is another object of this invention to provide an interconnecting electrical terminal section unit block adaptable for mounting in a ganged assembly, which interconnecting unit block contains disposed therein electrically combined electrical terminal elements and electrical connector elements, whereby upon failure of an arbitrary interconnecting unit block within the ganged assembly each terminal element and connector element therein is selectively separably removable and replaceable without repositioning, removing, or disassembling any of the interconnecting unit blocks forming the ganged assembly or without replacing the whole unit block which failed.

It is still another object of this invention to provide a detachable electrical terminal element having a key member thereon, suitable for insertion into a terminal-receiving cavity situate within an electrical terminal block, wherein the terminal-receiving cavity has a retention member therein adaptable to receive and capture the key member, such that, the retention member and key member selectively provide means for securing or removing electrical terminal elements inserted into the cavities.

It is yet another object of this invention to provide detachable electrical connector elements having seat means thereon, suitable for insertion into electrical connector-receiving cavities situate within an electrical terminal block and suitable for electrically uniting with terminal blades of electrical terminal elements inserted into the block at the seat means, whereby the seat means and the terminal blades jointly provide a means for selectively securing or removing the inserted connector elements without disassembling interconnecting sections comprising the block.

SUMMARY OF THE INVENTION

To the accomplishment of the foregoing objects and advantages, the present invention, in brief, comprises a one-piece constructed electrical terminal block of electrically insulating material for receiving electrical conductive wires therein. The block comprises a plurality of detachable electrical terminal elements which are adaptable for insertion into a corresponding plurality of terminal-receiving cavities provided within the internal confines of the block. Each terminal element has a protruding chamfered key member thereon to aid in retaining the inserted terminal element within its associated terminal-receiving cavity. Each terminal-receiving cavity contains a protruding retention member which extends into the terminal-receiving cavity. The retention member is provided with a protruding tapered shoulder and a protruding boss spaced from the tapered shoulder to form a recess therebetween. Upon insertion of a terminal element into the terminal-receiving cavity, the chamfered key member is adapted to abut against the boss and be captured within the recess. During withdrawal of the terminal-element from the terminal-receiving cavity, the chamfer on the key member permits the key member to slide over the protruding tapered shoulder and free itself from the recess, and thus, release the captured terminal element from the terminal-receiving cavity. The key member and retention member jointly provide a means for inserted terminal elements to be selectively secured or removed at the terminal-receiving cavity.

BRIEF DESCRIPTION OF THE DRAWINGS

The foregoing and still other objects and advantages of the present invention will be made more apparent from the following detailed explanation of the preferred embodiments of the invention in connection with the accompanying drawings wherein.

DETAILED EXPLANATION OF THE PREFERRED EMBODIMENTS OF INVENTION

Figure 1:
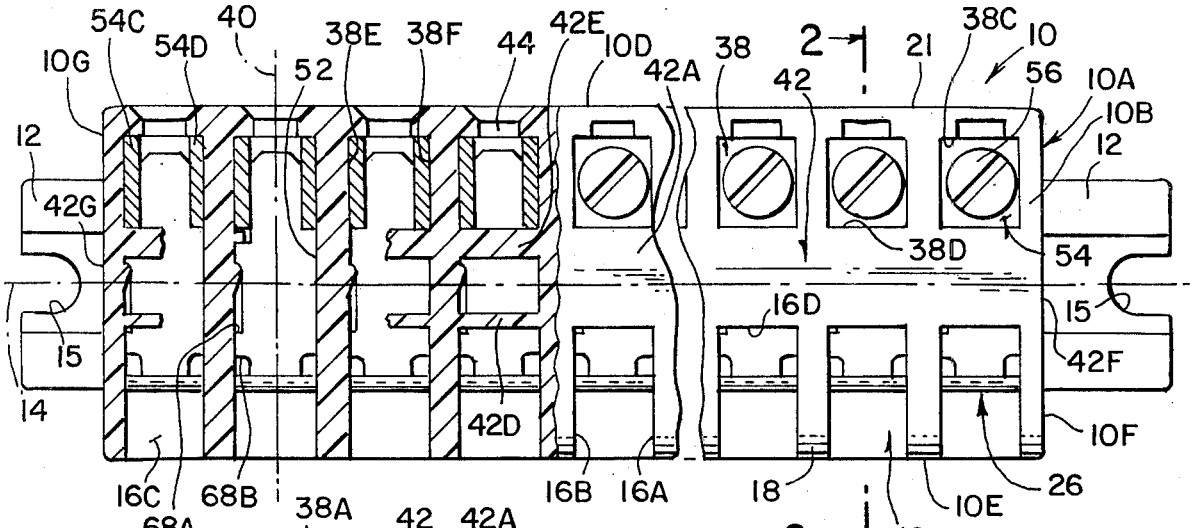
FIG. 1 is a top view illustrating an electrical terminal block constructed in accordance with the invention and partially broken away.
Figure 2:
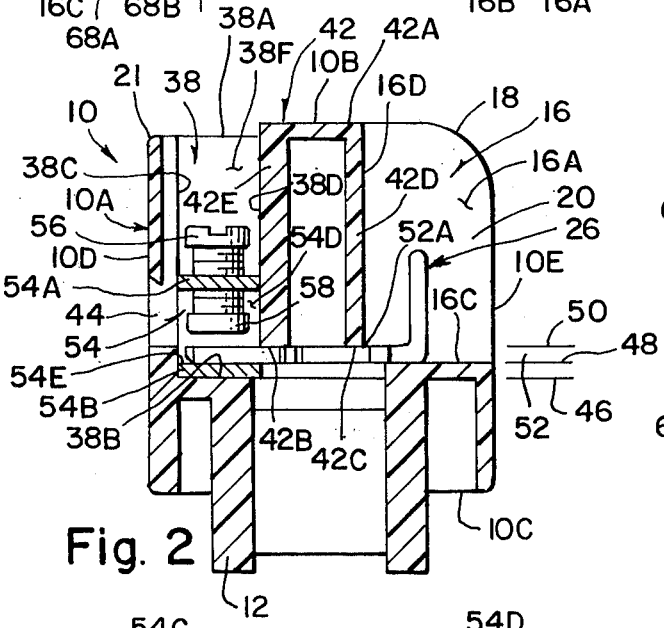
FIG. 2 is a cross-sectional view of the electrical terminal block of FIG. 1 taken along lines 2—2 of FIG. 1.
Figure 3:
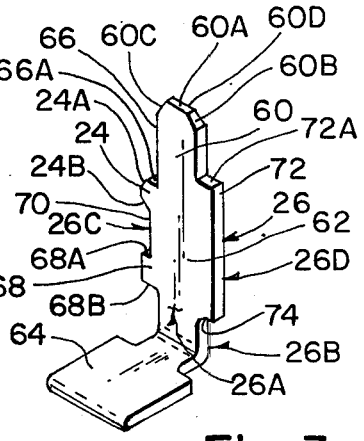
FIG. 3 is a perspective view of the electrical terminal element employed in the electrical terminal block of the invention.

Referring initially to FIGS. 1 and 2, there is shown one preferred form of the present invention comprising an electrical terminal block, generally indicated by reference numeral 10, for receiving a plurality of electrically conductive wires. Block 10 may comprise any one of the aforementioned terminal block types, that is, sectional, one-piece, or modular types. Block 10, however, is preferably an individually-molded, modular-type, one-piece, constructed, unit block having an electrically insulative body 10A generally in the form of an elongated or rectangular prism with top and bottom sides 10B and 10C, longitudinal sides 10D and 10E, and end sides 10F and 10G.

Block 10 is preferably conveniently molded in a known manner from a synthetic polymeric insulating or thermoplastic material, e.g., nylon and polyproplene. Although block 10 is preferably molded from synthetic polymeric materials, be it understood that other suitable materials having adequate insulating and strength characteristics upon being molded or otherwise formed may be employed, as will occur to those skilled in the art.

It will be noted that a conventional dovetail or grooved base 12 for mounting block 10 either directly on a generally flat supporting surface or foundation or on a mounting channel member in a known manner fully described, for example, in U.S. Pat. No. 3,245,029 incorporated herein by this reference, is provided at bottom 10C of body 10A. Dovetail 12 is integrally molded with bottom 10C and extends along a longitudinal median line 14 of body 10A. Neither the mounting channel member nor the flat base are herein shown. In typical mounting applications, as taught in the aforementioned U.S. Pat. No. 3,245,029, dovetail 12 is mounted upon the channel member, which channel member, in turn, is fastened to a supporting surface or foundation by bolting, riveting, or welding, etc. Dovetail 12 at each longitudinal extremity thereof includes through apertures 15 having an elongated slot configuration with an open end portion substantially as shown which may be used for mounting block 10 to the flat supporting surface with a threaded fastener or similar means, if desired.

In accordance with the preferred embodiment, body 10A of block 10 further comprises a plurality of laterally spaced generally elongate channel configured terminal-receiving cavities, generally designated as 16, which extend longitudinally along a corner edge 18 of intersecting top and longitudinal sides 10B and 10E, respectively, as is illustrated at FIGS. 1, 2. Each terminal-receiving cavity 16 includes two substantially perpendicular resiliently flexible opposed side walls 16A and 16B, a substantially flat base 16C and an inner wall 16D. Inner wall 16D and side walls 16A and 16B extend substantially perpendicular to base 16C. By virtue of the channel configuration of each terminal-receiving cavity 16, base 16C and opposed side walls 16A and 16B thereof form a slot or recess 20 having an open end between corner edge 18 and base 16C. Slot 20 extends inwardly from corner edge 18 in a transverse direction to terminate at inner wall 16D short of longitudinal median line 14.

Figure 4:
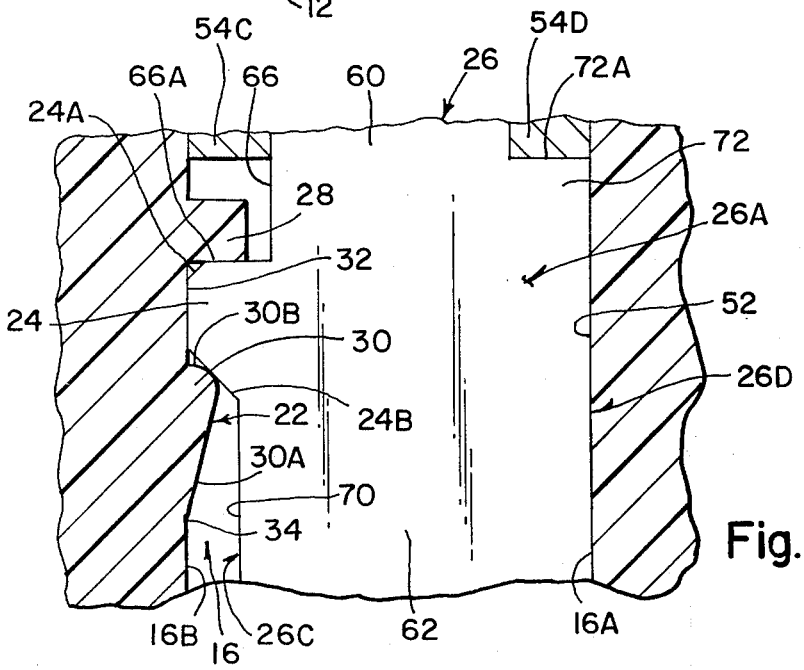
FIG. 4 is an enlarged view (partly in section) of a fragmentary portion of the electrical terminal element and the electrical terminal block of the invention.

In accordance with the present invention, one opposed side wall 16B of each terminal-receiving cavity 16 is provided with a protruding retention member or means formed integrally therewith, generally designated as 22 at FIG. 4, for capturing and interfitting with a complementary key member or means on a corresponding inserted electrical terminal element, generally designated as 24, as will be more fully described hereinafter. Retention member 22 is positioned in slot 20 on side wall 16B intermediate inner wall 16D and longitudinal side wall 10D of block body 10A, such that, retention member 22 projects laterally into an internal recess communicating with terminal-receiving cavity 16 as will also be more fully described below. Retention member 22 consists of a protruding tab or rectangular shaped boss 28 and a protruding substantially tapered shoulder or flange 30. Boss 28 is located on side wall 16B and is spaced from tapered shoulder 30, such that, a rectangular shaped pocket or recess 32, of a size suitable for permitting the insertion of key member 24 therein, is formed between boss 28 and shoulder 30 substantially as shown in FIG. 4.

Tapered shoulder 30 of retention member 22 increases in lateral width to define a tapered surface 30A, which surface tapers with respect to side wall 16B, from a point 34 on side wall 16B toward boss 28. Tapered surface 30A of shoulder 30 is inclined at an angle of approximately 15° with respect to side wall 16B and merges at its point of greatest taper into a fillet 30B. Fillet 30B is in the general form of an arc, and extends toward and joins side wall 16B substantially as shown in FIG. 4.

A plurality of laterally spaced recessed connector-receiving cavities, generally designated as 38, are also provided by body 10A which longitudinally extend along topside 10B of body 10A near corner edge 21 of intersecting top and longitudinal sides 10B and 10D. Each connector-receiving cavity 38 corresponds to a terminal-receiving cavity 16, and each corresponding terminal-receiving cavity 16 and connector-receiving cavity 38 is positioned within body 10A in a paired relationship so as to extend along and have a common transverse axis 40. A barrier 42, molded integrally with body 10A, extends longitudinally along median line 14 and separates the upper portion of each terminal-receiving cavity 16 and connector-receiving cavity 38 that are in a paired relationship from one another. Each connector-receiving cavity 38 includes a top open end portion 38A and a recessed base 38B, vertically spaced from one another by four substantially perpendicular side walls 38C, 38D, 38E and 38F.

A plurality of rectangularly configured openings or apertures 44 for enabling insertion of external conductive wires, not here shown, into connector-receiving cavities 38 are spaced longitudinally along longitudinal side 10D. As shown in FIGS. 1 and 2, each side aperture 44 extends through side 10D of block body 10A in a direction along transverse axis 40, and opens into a corresponding vertically recessed connector-receiving cavity 38 associated therewith.

It is to be observed that each base 38B of connector-receiving cavities 38 is situate in body 10A intermediate top and bottom sides 10B and 10C, respectively, at identical vertical distances in a manner to commonly lie in a first imaginary substantially horizontal plane indicated by line 46 in FIG. 2. Similarly, each base 16C of terminal-receiving cavities 16 is also situate intermediate top and bottom sides 10B and 10C, respectively, at identical vertical distances in a manner to commonly lie in a second imaginary substantially horizontal plane indicated by line 48 in FIG. 2. However, as also indicated at FIG. 2, the second imaginary horizontal plane 48 including bases 16C of terminal-receiving cavities 16 is spaced a vertical distance from bottom 10C of block 10 greater than that of the first horizontal plane 46 including bases 38B of connector-receiving cavities 38.

In referring again to barrier 42, this portion of block 10A comprises a substantial flat upper surface 42A, which merges with top side 10B at opposed longitudinally extending lateral edges thereof; lower surfaces 42B and 42C; opposed longitudinally extending side walls 42D and 42E; and end walls 42F and 42G. As best seen in FIGS. 1 and 2, the segments of each longitudinally extending side wall 42D and 42E actually define the inner side walls 16D and 38D in each corresponding pair of complementary terminal-receiving cavities and connector-receiving cavities 16 and 38 astride transverse axis 40.

Similarly, the opposed end walls 42F and 42G of barrier 42 are, actually, intermediate segments of end sides 10F and 10G, respectively, of body 10A. It is further apparent that end side 10G of body 10A including end wall 42G of barrier 42 defines the side walls 38E and 16B for the pair of complementary terminal-receiving cavities and connector-receiving cavities 16 and 38 astride transverse line 40 at one longitudinal extremity of body 10A. Likewise, end side of body 10A including end wall 42F of barrier 42 defines sidewalls 16A and 38F of the pair of complementary terminal-receiving cavities and connector-receiving cavities 16 and 38 astride transverse axis 40 at the other longitudinal extremity of body 10A.

As shown in FIG. 2, lower surfaces 42B and 42C of barrier 42 commonly lie in a third imaginary horizontal plane, designated as 50, positioned intermediate top and bottom sides 10C and 10B of body 10A, such that, plane 50 is a vertical distance closer to topside 10B of body 10A than either horizontal planes 46 or 48. Thus, it will be appreciated, in view of the aforesaid block structure, that a plurality of longitudinally spaced internal recesses 52, one for each pair of complementary terminal-receiving cavities and connector-receiving cavities 16 and 38 astride transverse line 40, are provided by body 10A as a consequence of lower surfaces 42B and 42C of barrier 42 being spaced from bases 16C and 38B of the terminal-receiving cavities and connector-receiving cavities 16 and 38, with each of said recesses 52 having an opening 52A defined by bottom surface 42C and base 16C for receiving a corresponding terminal element 26 as will be more fully described below.

Referring again to FIGS. 1 and 2, each connector-receiving cavity 38 is adapted to have disposed therein detachable or completely-removable electrical connector elements generally designed as 54. In the preferred form, each connector element 54 consists of a conventional tubular connector contact such as that fully described, for example, in U.S. Pat. No. 3,930,706 incorporated herein by this reference. As taught in the aforesaid reference, each connector element 54 consists of a length of metal tubing, rectangular in cross-section, having top and bottom walls 54A and 54B, respectively, two side walls 54C and 54D, and a screw 56 threaded through its top wall 54A. A bottom 58 of screw 56 is used to provide pressure on an inserted external wire conductor so as to trap the conductor in electrically engaging contact between bottom 58 of screw 56 and base 54B of connector element 54. Notably, the top surface of base 54B also functions to provide a seating surface designated as 54E, which faces in a direction toward lower surfaces 42B and 42C of barrier 42, for receiving the front end portion of terminal element 26 thereon when assembled into body 10A at the terminal-receiving cavity 16. The height of base 54B is preferably equal to or less than the vertical distance between imaginary planes 46 and 48 which facilitates the seating of the front end portion of terminal element 26 at top surface 54E of connector 54.

Directing attention to terminal elements 26, as illustrated in FIGS. 1 through 4, a plurality of terminal elements 26 adaptable for insertion into a complementary plurality of terminal-receiving cavities 16 and recesses 52 are shown disposed therein. Each terminal element 26 comprises a body consisting of a generally flat length of a well known conductive metal such as tin, brass, bronze, gold, copper and silver, etc. In its preferred form, however, a copper alloy is employed. The body of terminal element 26 comprises substantially parallel opposed top and bottom sides 26A and 26B; opposed lateral sides 26D and 26C which, aforesaid four sides 26A, 26B, 26D and 26C, in turn, define a front terminal blade end 60, an intermediate terminal segment 62 and a back terminal end 64. Front terminal blade end 60 and back terminal end 64 extend longitudinally outwards from intermediate terminal segment 62 in diametrically opposed directions with respect to one another.

Front terminal blade end 60 is of a width suitable for being received between sidewalls 54C and 54D of connector 54 and as aforesaid, extends longitudinally outwards from intermediate terminal segment 62. Front terminal blade 60 terminates at a leading transverse edge 60A which is provided with double chamfers 60B and 60C at opposite corners thereof. Chamfers 60B and 60C are inclined at an angle of approximately 45° with respect to leading edge 60A and are equal in length. The preferred length of chamfers 60B and 60C is about 0.03 of an inch (0.76 mm). Transverse edge 60A is also provided with a third chamfer 60D formed on bottom side 26B, such that, the full transverse width of transverse edge 60 along bottom side 26B is beveled. Chamfer 60D is inclined at an angle of approximately 45° with respect to top side 26A.

Intermediate terminal segment 62 is shaped such that lateral side portion 26D thereof has a greater longitudinal length than that of its opposite lateral side 26C. The laterally protruding key member or locking tab 24 thereon is a generally rectangular shaped segment and extends transversely or laterally outwardly from the shorter lateral side portion 26C.

Key member 24 includes double substantially flat beveled or chamfered surfaces 24A and 24B at opposed protruding corners thereof as is best illustrated at FIG. 4. Chamfered surface 24A is preferably inclined at an angle of approximately 45° with respect to a straight lateral edge thereof, has a preferred length of approximately 0.01 of an inch (0.257 mm), and faces in a direction towards leading transverse edge 60A of terminal blade 60. A portion of key 24 extending inwardly from chamfer 24A joins or merges with side 26C of terminal element 26 in a step or L-shaped configured shoulder 66. Shoulder 66 is provided with a bearing surface 66A facing in a direction towards leading edge 60A.

The other chamfered surface 24B of key 24 is preferably inclined at an angle of approximately 45° with respect to the straight lateral edge and faces in a direction towards the back terminal end 64. A portion of chamfer 24B joins or merges with lateral side portion 26C of intermediate blade segment 62. However, the beveled edge of chamfer 24B, clearly visible at FIG. 4, is of a length suitable for allowing key member 24 to free itself of fillet 30B during withdrawal of inserted terminal elements 26 as will be fully explained in a later section herein. In a preferred form, the length of chamfer 24B is roughly three and one-half times the preferred length of chamfer 24A.

A protruding rectangular shaped guiding tab 68 is also provided by intermediate terminal segment 62. Guiding tab 68 is situate on shorter lateral side 26C and is spaced thereon from key member 24 in a manner to form two generally stepped or L-shaped configured shoulders 68A and 68B, as illustrated in FIG. 1. Shoulder 68B joins back terminal end 64 in a general step-configuration as a consequence of a portion of terminal 26, where intermediate segment 62 merges with back terminal end 64, having a transverse width narrower than either the transverse width of intermediate segment 62 or the extremities of back terminal end 64. Similarly, shoulder 68A joins lateral side portion 26C of intermediate terminal segment 62 in a step configuration as a consequence of tab 68 projecting transversely outwards from side 26C. Notably, in view of the foregoing construction of tab 64 and key member 24, it is apparent that a rectangular slot-like recess 70 is formed therebetween.

The longer lateral side portion 26D of intermediate segment 62 also comprises two generally L-shaped or step configured shoulders 72 and 74 which define opposed distal end portions or extremities of the longer lateral side portion 26D. Another bearing surface 72A is provided by shoulder 72 which faces in a direction towards leading transverse edge 60A of terminal blade 60.

Back terminal end 64 extends longitudinally outwards from between shoulder 68B of tab 68 and shoulder 74 of the longer lateral side portion 26D of intermediate terminal segment 62. Back terminal end 64 may be inclined at any arbitrary angle with respect to intermediate segment 62, such that, the inclined portion is suitably positioned for attaching thereto external electrical conductors.

In one preferred method of assembling connector elements 54 and terminal elements 26 into block 10, and of hooking up the external wire conductors thereto, connector elements 54 are first fully inserted into connector-receiving cavities 38. When fully inserted therein, bottom 54B and side walls 54C and 54D of each connector element 54 are respectively contiguous with base 38B and side walls 38C and 38D of the connector-receiving cavity 38, such that, seating surface 54E is enabled to receive thereon terminal blade 60 of inserted terminal element 26, and is also enabled to receive the end of the inserted external wire conductor between bottom 58 of clamping screw 56 and top surface 26A of terminal blade 26, when the external conductor is inserted into the shell of connector element 38 via side aperture 44 in block 10.

Next terminal elements 26 are inserted into corresponding terminal-receiving cavities 16. During insertion chamfer 60D and double chamfers 60C and 60A, on terminal blade 60, as well as chamfer 24A on key 24 permit terminal blade 60 to slide into terminal-receiving cavity 16, pass through opening 52A and into internal recess 52, and electrically engage seating surface 54E without substantial binding or restriction during entry therein. Specifically, chamfer 24A aids key 24 in riding over tapered shoulder 30; chamfer 60D aids terminal blade 60 to ride onto seating surface 54E; and chamfers 60B and 60C aid terminal blade 60 to enter between sidewalls 54C and 54D of connector element 54. Similarly, guiding tab 68 generally assures proper alignment for terminal element 26 during insertion and further aids in assuring that terminal blade 60 properly seats at seating surface 54E, as well as aids in assuring proper alignment for key member 24 to interlockingly engage retention member 22 during insertion.

Additionally, during insertion of each terminal element 26 into a terminal-receiving cavity 16 associated therewith, opposed sidewalls 16A and 16B of terminal-receiving cavity 16 slightly flex outwardly away from one another. By flexing, opposed sidewalls 16A and 16B contribute in permitting key 24 to slide or ride on, and thus, over and beyond tapered shoulder 30, and be captured by retention member 22. Notably, an interference is established between intermediate segment 62 of terminal element 26 and walls 16A and fillet 30B during insertion. It should also be noted the general arc shape of fillet 30B provides a round surface upon which chamfer 24A of key 24 may readily slide over, thus, facilitating key 24 to locate within recess 32 of retention member 22.

During insertion of terminal element 26 into terminal-receiving cavity 16, boss 28 of terminal-receiving cavity 16 provides a surface against which the bearing surface 66A of key 24 is abuttingly located. Similarly, as shown in FIG. 1, sidewall 54D of connector element 54 provides another surface to abuttingly locate the second bearing surface 72A of shoulder 72 on the longer side portion 26D of intermediate terminal segment 62. Further, lower surfaces 42B and 42C of barrier 42 are contiguous with topside 26A of each inserted terminal element 26, and abuttingly engage the topside 26A of each terminal element in a supporting manner. Similarly, bases 16C of terminal-receiving cavities 16 are contiguous with bottom sides 26B of each inserted terminal element 26 associated therewith and are thus adapted to abuttingly engage the bottom sides 26B of each inserted terminal in a supporting manner.

Notably, bases 38B abuttingly engage the underside of the bottom side 54B of each connector element 54 in a supporting manner, and therefore, are adapted to support the terminal blade 60 of each terminal 26 when the latter is seated on seating surface 54E. Since bottom sides 54B of connector elements 54 are sandwiched between terminal blade 60 and bases 38B of connector-receiving cavities 38 the connector elements 54 are positively captured or held in place by the confines of connector-receiving cavities 38 and the terminal blade 60 of the captured inserted terminal elements 26.

Hence, in view of the aforedescribed structure and method of assembly, it is to be understood that the interlocking key member 24 and retention member 22 afford a means for positively retaining the inserted terminal elements 26 within block 10 with respect to transverse and lateral movement thereof, while the lower surfaces 42B and 42C of barrier 42 and bases 16C of terminal-receiving cavities jointly afford means for positively retaining the inserted terminal elements 26 within block 10 with respect to vertical movement thereof or with respect to displacements substantially normal to the lower barrier surfaces 42B and 42C. Nonetheless, it will be noted that inserted terminal elements 26 are slightly axially adjustable in order to enable terminal elements 26 to electrically connect with misaligned connectors of external circuits when inserted into apertures 44. To this end, each recess 32 and each recess 52 is of a size suitable for permitting terminal elements 26, when key 24 is captured, to freely move in a direction along transverse axis 40 a distance of approximately ±0.020 inches (0.5 mm).

It is to be further understood that terminal elements 26 may be push or snap-inserted into terminal-receiving cavities 16 by hand or a light instrument, such as, for example, a screwdriver blade or pliers. The order of force required to insert terminal elements 26 into terminal-receiving cavities 16, generally speaking, is less than the force required to withdraw terminal elements 16 therefrom, whereas connector elements 54 may be substantially freely slidably inserted into or withdrawn from their associated connector-receiving cavities 38.

Lastly, the external wire connectors are electrically connected to the connector elements 54, via insertion of ends thereof through side apertures 44, and are electrically connected to the terminal elements 26 via the open ends afforded by slots 20 of terminal-receiving cavities 16. The external wire conductors may be hooked-up to terminal elements 26 through a variety of conventional ways, such as by soldering, crimping, nuts, bolts or other similar conventional fastener hardware, but are preferably connected to terminal elements 26 at back ends 64 thereof with push-on quick-disconnect connectors when No. 12 or smaller size wires are utilized.

It will be appreciated that when connecting an external conductor to connectors 54, a bared wire of the conductor is inserted into opening 44 and received between the bottom 58 of clamping screw 56 and top of terminal blade 60 whenever the clamping screw is tightened down to securely electrically and mechanically engage the wire against the terminal blade 60 in a known manner.

To disassemble block 10, the reverse procedure for assembling block 10 is followed. During withdrawal of terminal elements 26 from terminal-receiving cavities 16, walls 16A and 16B thereof again flex outwards from one another. This facilitates the release of key 24 from pocket 32, by aiding chamfer 24B of key 24 to slide over fillet 30B, thus, enabling key 24 to reach taper 30A and slide thereover with little or no binding. It is to be understood that generally speaking as a result of the aforedescribed structure pertaining to tapered surface 30A, chamfer 24B, fillet 36 and resiliently flexible walls 16A and 16B, greater force is required to withdraw terminal 26 from recess 52 and cavity 16 than to insert the terminal 26 therein.

When terminal element 24 is partially withdrawn such that the terminal blade 60 is no longer seated at seating surfaces 54E of connector elements 54, each inserted connector element 54 is released and is free to be withdrawn from its associated connector-receiving cavities 38. Hence, it is readily apparent that each connector element 54 is selectively separably removable and replaceable, as is each terminal element 26, upon withdrawing the inserted terminal elements 26 paired therewith from recess 52 and terminal-receiving cavity 16.

From the foregoing it will be appreciated that the present invention in its broadest aspect relates to a novel interlocking retention member 22 and key member 24 for facilitating selective separable retention or removal of terminal elements 26 and connector elements 54 within block 10. Although several preferred embodiments have been hereinabove described as required by statute, it will be understood that many variations and modifications hereof may occur to those skilled in the art, without departing from the principles of the invention. For example, in one broad aspect of the present invention interconnecting sectional unit block assemblies containing solely one connector element and one terminal element therein may occur, or a block body not comprising connector-receiving cavities 38, and thus, not comprising connector elements 54 could occur, in which case, terminal elements 26 could be constructed without the front terminal blade portions 60.

Also, back terminal ends 64 could comprise a plurality of conventional push on quick-connect connectors. It should be further understood that the employed connector elements 54 need not be conventional tubular connector types, and may comprise other connector types having shapes suitable to fit the contours or confines of the recessed portions of the connector-receiving cavities 38. Likewise, the contours or confines of the recessed portions defining the connector-receiving cavities 38, may also comprise several other shapes complementary to the shape of the connector elements 54 to be inserted therein.

Additionally, each elongated slot configured through aperture 15 could be replaced with a partially recessed rectangular-shaped snap-locking aperture, not here shown, for mounting block 10, via completely removable fastener pins, also not here shown which are adaptable for being received within the snap-locking apertures. Each snap-locking aperture may comprise two internal resiliently flexible vertical side walls that have at intermediate sections thereof protruding latches, having knife-shaped edges, that extend transversely into the snap-locking apertures. The fastener pins may be secured to suitable surfaces at first ends thereof and inserted into the snap-locking apertures at second ends thereof. The second ends of the fastener pins are provided with a clasping means, such as a notch or a protruding flange or lip that is adaptable for enabling the latches to snap and lock within or under the clasping means, respectively, thus locking the block 10 and fastener pin to one another. During withdrawal of the fastener pins from the snap-locking apertures, the resiliently flexible opposed side walls flex outwardly away from one another which enables the latch and clasping means to be free or unlock, thus unlocking or freeing mounted block 10.

Accordingly, it is desired that the subject invention be limited only by the spirit and scope of the appended claims.

I claim:

1. An electrical connector comprising:

(a) a terminal block of electrically insulating material;

(b) at least one terminal-receiving cavity in said block;

(c) an electrical terminal element adaptable for insertion in said terminal-receiving cavity, said terminal element having a key member thereon for positively securing said terminal element in said terminal-receiving cavity, said terminal element having a generally flattened shape including a pair of transversely spaced opposed sides, and further comprising: a back end portion; an intermediate portion, and a front blade portion, said intermediate portion having on one of said opposed sides said key member projecting therefrom and having on the other of said opposed sides a shoulder means, said shoulder means being spaced longitudinally and transversely from said key member and defining a terminal end region of said intermediate portion, said shoulder means being adaptable to position said front end of said terminal element relative to said terminal-receiving cavity, and being adaptable to position said key member relative to a retention member for capturing said key member upon said insertion of said terminal element; and (d) said retention member extending into said terminal-receiving cavity, said retention member including a shoulder having a tapered surface and a boss spaced from said shoulder to form a recess therebetween, said key member being adaptable to be captured within said recess when said terminal is inserted in said terminal-receiving cavity, whereby said retention member and said key member provide a means for selectively securing or removing each terminal element from said terminal-receiving cavity.

2. The terminal block as recited in claim 1 wherein said at least one terminal-receiving cavity comprises resiliently flexible opposed side walls, said tapered surface of said shoulder and said boss of said retention member being situate on only one of said opposed walls, whereby upon said insertion of said terminal element into said at least one terminal-receiving cavity said key member is adapted to be said captured in said recess.

3. The terminal block as recited in claim 2 wherein said resiliently flexible opposed side walls of said at least one terminal-receiving cavity flex outwardly during insertion and withdrawal of said terminal element to allow said key means to respectively slide freely into and out of said recess between said shoulder means and said boss means.

4. The block as recited in claim 1, further comprising at least one connector-receiving cavity adaptable for removably receiving an electrical connector element therein, said shoulder means being adapted to abuttingly engage said connector element when said terminal element is said inserted in said terminal-receiving cavity, said abutting engagement between said shoulder means and said connector element substantially aiding said key member to be said captured by said retention member by positioning said key member longitudinally within said terminal receiving cavity relative to said retention member.

5. An electrical connector comprising:

(a) a terminal block of electrically insulating material;

(b) at least one terminal-receiving cavity in said block, said at least one terminal-receiving cavity comprising a pair of resiliently flexible transversely spaced opposed side walls;

(c) an electrical terminal element adaptable for insertion in said terminal-receiving cavity, said terminal element having a key member thereon;

(d) a retention member, said retention member being situate on one of said opposed side walls so as to extend into said terminal-receiving cavity, said retention member including a shoulder having a tapered surface and a boss spaced from said shoulder to form a recess therebetween, said tapered shoulder being situate on said one opposed wall in a manner to prevent transverse movement thereof, said key member being adaptable to be captured within said recess when said terminal is inserted in said terminal-receiving cavity, whereby said retention member and said key member provide a means for selectively securing or removing each terminal element from said terminal-receiving cavity, and whereby upon said insertion and withdrawal of said terminal element said opposed side walls flex transversely away from one another so as to allow said key member to be respectively captured and removed at said retention member, and wherein said terminal element is generally flat in shape and comprises: a back end portion, an intermediate portion, and a front blade portion, said intermediate portion having on one side thereof said key member projecting therefrom.

6. The terminal block as recited in claim 5 wherein said terminal element further comprises a projecting tab member spaced from said key means for guiding said terminal element into said terminal-receiving cavity during said insertion thereof, said tab member and said key means having a generally rectangular shape, said key means having double chamfers thereon at opposite corners thereof, and wherein a first said chamfer permits said key member during said insertion of said terminal element in said at least one terminal-receiving cavity to said locate between said shoulder and said boss without binding, and a second chamfer permits said key member to said slide free of said location between said shoulder and said boss during said withdrawal of said terminal element.

7. An electrical connector comprising:

(a) a terminal block of electrically insulating material;

(b) at least one terminal-receiving cavity in said block;

(c) an electrical terminal element adaptable for insertion in said terminal-receiving cavity, said terminal element having a key member thereon for positively securing said terminal element in said terminal-receiving cavity;

(d) a retention member for capturing said key member, said retention member extending into said terminal-receiving cavity, said retention member including a shoulder having a tapered surface and a boss spaced from said shoulder to form a recess therebetween, said key member being adaptable to be captured within said recess when said terminal is inserted in said terminal-receiving cavity, whereby said retention member and said key member provide a means for selectively securing or removing each terminal element from said terminal-receiving cavity, and wherein said block further comprises an elongate shape and includes therein at least one connector-receiving cavity and a barrier separating said at least one connector-receiving cavity from said at least one terminal-receiving cavity, said at least one terminal-receiving cavity being situate transversely in said block with respect to said connector-receiving cavity, said connector-receiving cavity defining a base means adaptable for supporting only a front blade end portion of said inserted terminal element, said terminal-receiving cavity defining a base means adaptable for supporting only a back end of portion said inserted terminal element, said base means of said connector-receiving cavity and said base means of said terminal-receiving cavity being spaced transversely from one another, said barrier extending axially along a longitudinal axis passing through said block said barrier having a bearing surface located on a lower face thereof, said base means of said terminal-receiving cavity and said base means of said connector-receiving cavity having surfaces facing said bearing surface of said barrier, said bearing surface and said base means of said connector-receiving cavity and said base means of said terminal-receiving cavity affording a means to positively retain said inserted terminal element within said block with respect to displacement substantially normal thereinbetween.

8. The terminal block as recited in claim 7 wherein said base of said terminal-receiving cavity is situate at an end from which said terminal element is inserted therein, said base of said terminal-receiving cavity being contiguous with a bottom surface of said back end portion of said inserted terminal element, and said base of said terminal-receiving cavity being spaced vertically from said base of said connector-receiving cavity.

9. The terminal block as recited in claim 7 further comprising a removable electrical connector element adaptable for disposing in said at least one connector-receiving cavity, each said at least one connector element having a seat means thereon, each said seat means being adaptable for receiving a front blade end of said inserted terminal element, said seat means of said connector element and said base means of said terminal-receiving cavity lying substantially in a same imaginary horizontal plane of said block upon said disposing said connector element in said connector-receiving cavity, wherein said blade end of said inserted terminal element when said received by said seat means captures said connector element within said at least one connector-receiving cavity, said captured terminal element being suspended between said seat means and said base of said terminal-receiving cavity.

10. The terminal block as recited in claim 9 wherein each said at least one connector-receiving cavity comprises side walls and a bottom for housing said connector element disposed therein, said side walls and said bottom being adaptable to be contiguous with corresponding side walls and bottom of said connector element, whereby said connector element is positively secured in said at least one connector-receiving cavity by confines of said side wall and said bottom defining said connector-receiving cavities when said connector elements are said disposed therein and said blade end of said terminal elements are said received by said seat means.

11. The terminal block as recited in claim 10 wherein said connector elements are tubular connectors and said seat means are flat base portions of said connector elements, and wherein upon inserting said connector element within said at least one connector receiving cavity, said flat base portions lie adjacent said bottom portion of said at least one said connector-receiving cavity, and said blade end of said terminal element said captures said tubular connector by sandwiching said flat base portion of said tubular connector between said blade and said bottoms of said connector-receiving cavity.

12. The terminal block as recited in claim 11 wherein said terminal elements and said connector elements are disposed in said at least one terminal-receiving and connector-receiving cavity, respectively.

13. An electrical connector comprising:

(a) a terminal block of electrically insulating material;

(b) at least one terminal-receiving cavity in said block;

(c) an electrical terminal element adaptable for insertion in said terminal-receiving cavity, said terminal element having a key member thereon for positively securing said terminal element in said terminal-receiving cavity;

(d) a retention member for capturing said key member, said retention member extending into said terminal-receiving cavity, said retention member including a shoulder having a tapered surface and a boss spaced from said shoulder to form a recess therebetween, said key member being adaptable to be captured within said recess when said terminal is inserted in said terminal-receiving cavity, whereby said retention member and said key member provide a means for selectively securing or removing each terminal element from said terminal-receiving cavity, wherein said at least one terminal-receiving cavity comprises resiliently flexible opposed side walls, said tapered surface of said shoulder and said boss of said retention member being situate on only one of said opposed walls, whereby upon said insertion of said terminal element into said at least one terminal-receiving cavity said key member is adapted to be said captured in said recess, and wherein said tapered surface of said shoulder merges into a fillet in the general form of an arc that joins said one opposed side wall, said shoulder decreasing in lateral width, with respect to said opposed side wall, from said fillet toward a direction in which said terminal element is inserted, said shoulder and a remaining wall of said opposed sidewalls forming an interference fit with said terminal element when said inserted thereinbetween.

14. The terminal block as recited in claim 13 wherein said taper of said shoulder and said fillet thereof permits said key member during said insertion of said terminal elements to slide beyond said interference fit and be captured within said recess defined by said retention member, and wherein said fillet further prevents said key member, and thus, said inserted terminal element from backing out of said at least one terminal-receiving cavity.

15. In a terminal connector block for receiving electrical connections comprising:

(a) a terminal element adaptable for selective insertion into and removal from said connector block, said terminal element comprising a key member situate on an intermediate portion thereof for retaining said terminal element within said block;

(b) an electrical connector element adaptable for insertion into said connector block, each said connector element comprising a seat means therein adaptable for receiving one end of said terminal element;

(c) a terminal-receiving cavity extending inwardly from and along one side of said connector block, said terminal element, said terminal-cavity comprising a retention member projecting from one opposed side wall therein for retaining said inserted terminal element within said terminal-receiving cavity, said retention member being adaptable to lockingly engage said key member when said terminal element is inserted within said terminal-receiving cavity, each said terminal-receiving cavity further comprising a base means for supporting only a first end of two opposed end portions of said inserted terminal element;

(d) a recessed connector-receiving cavity disposed transversely of said terminal-receiving cavity and extending along an opposite side of said connector block, said connector-receiving cavity comprising side walls and a bottom, said side walls and said bottom being adaptable to be contiguous with corresponding sides of said connector element, said connector-receiving cavity having disposed therein said connector element, said bottom of said disposed connector element being transversely spaced from said base of said terminal-receiving cavity, wherein a second end portion of said terminal element member, when said received by said seat means, captures said connector element within confines defined by said side walls and bottom of said connector-receiving cavity; and (e) barrier means for separating said connector-receiving cavity from said terminal-receiving cavity, said barrier comprising a bearing face abutting an upper surface of an intermediate portion of said inserted terminal element, said bearing face being located on a lower surface of said barrier so as to face said base of said terminal-receiving cavity, whereby said inserted terminal element is positively retained in said terminal-receiving cavity by said retention means said engaging said key means, said bearing face, and said base of said cavity, and whereby a lower surface of said intermediate portion of said inserted terminal element is free on all portions thereof.

16. An electrical terminal element adaptable for insertion into a terminal-receiving cavity of a terminal block comprising:

(a) a terminal blade portion adaptable for electrically connecting to at least one circuit;

(b) a terminal end portion adaptable for electrically connecting to at least one different circuit; and (c) an intermediate portion extending between said blade portion and said end portion, said intermediate portion comprising a protruding key member thereon adaptable for locking said inserted terminal element into a recessed keyway of said terminal-receiving cavity, said key member having a first chamfered surface thereon, said chamfered surface enabling said key member to be locked in said recessed keyway when inserting said terminal element into said terminal-receiving cavity, and wherein said terminal element comprises a seat means thereon, said seat means defining an end region of said intermediate portion, said seat means being spaced both transversely and longitudinally from said key member so as to substantially enable said key member to be positioned longitudinally within said terminal-receiving cavity and to substantially enable said terminal blade portion to be positioned adjacent said terminal-receiving cavity.

17. An electrical terminal element as recited in claim 16 further comprising a second chamfered surface thereon, said second chamfered surface enabline said key member to become free of said recessed keyway when withdrawing said inserted locked terminal element from said terminal-receiving cavity.

18. An electrical terminal element adaptable for insertion into a terminal-receiving cavity of a terminal block comprising:

(a) a terminal blade portion adaptable for electrically connecting to at least one circuit;

(b) a terminal end portion adaptable for electrically connecting to at least one different circuit; and (c) an intermediate portion extending between said blade portion and said end portion, said intermediate portion comprising a protruding key member thereon adaptable for locking said inserted terminal element into a recessed keyway of said terminal-receiving cavity, said key member having a first chamfered surface thereon, said chamfered surface enabling said key member to be locked in said recessed keyway when inserting said terminal element into said terminal-receiving cavity, and wherein said electrical terminal element further comprises a second chamfered surface thereon, said second chamfered surface enabling said key member to become free of said recessed keyway when withdrawing said inserted locked terminal element from said terminal-receiving cavity, and wherein said terminal element comprises an elongated narrow flat strip of conductive material, and wherein said key member thereof further comprises a rectangular configuration, said first and second chamfered surfaces being at opposed distal corners thereof, said first chamfered surface defining a beveled edge of a length less than a length of a beveled edge defining said second chamfer.

19. An electrical terminal element adaptable for insertion into a terminal-receiving cavity of a terminal block comprising:

(a) a terminal blade portion adaptable for electrically connecting to at least one circuit;

(b) a terminal end portion adaptable for electrically connecting to at least one different circuit;

(c) an intermediate portion extending between said blade portion and said end portion, said intermediate portion comprising a protruding key member thereon adaptable for locking said inserted terminal element into a recessed keyway of said terminal-receiving cavity, said key member comprising a rectangular configuration, said key member having a first chamfered surface thereon, said first chamfered surface enabling said key member to be locked in said recessed keyway when inserting said terminal element into said terminal-receiving cavity; and further comprising a second chamfered surface thereon, said second chamfered surface enabling said key member to become free of said recessed keyway when withdrawing said inserted locked terminal element from said terminal-receiving cavity, said second chamfered surface defining a beveled edge of a length greater than a beveled edge defining said first chamfered surface, and wherein said intermediate portion further comprises a protruding tab means adaptable for guiding said terminal element into and out of said terminal-receiving cavity during said insertion and withdrawal, said guiding means being spaced from said key means.

20. The terminal element as recited in claim 19 wherein said blade portion and said end portion are each adaptable for receiving thereon electrical connectors associated with electrical conductors of said at least one circuit and said at least one different circuit respectively.

* * * * *